US005611552A

United States Patent [19]

Miles et al.

[11] Patent Number: 5,611,552

[45] Date of Patent: Mar. 18, 1997

[54] FOLDABLE CREEPER

[75] Inventors: Joseph J. Miles; Joseph B. Miles, both of Okeechobee, Fla.

[73] Assignee: Mechanic Accessories, Inc., Okeechobee, Fla.

[21] Appl. No.: 526,409

[22] Filed: Sep. 11, 1995

[51] Int. Cl.[6] ..... B25H 5/00

[52] U.S. Cl. ..... 280/32.6; 280/639; 280/32.5

[58] Field of Search ..... 280/32.5, 32.6, 280/639, 640, 651, 79.11; 403/102

[56] References Cited

U.S. PATENT DOCUMENTS

| | | | |
|---|---|---|---|
| D. 270,962 | 10/1983 | Martell | 280/32.6 |
| D. 285,018 | 8/1986 | Quinonez | D34/17 |
| D. 289,815 | 5/1987 | Quinonez | D34/17 |
| 546,993 | 10/1895 | Bigalow | 280/32.5 |
| 781,243 | 1/1905 | Thompson | 280/32.6 |
| 1,226,585 | 5/1917 | Parker et al. | 280/32.6 |
| 1,302,301 | 4/1919 | Broome | 280/32.6 |
| 1,643,268 | 9/1927 | Burnwatt | 280/32.6 |
| 2,084,957 | 6/1937 | Hulbert | 280/32.6 |
| 2,509,934 | 5/1950 | Murray | 280/32.6 |
| 3,677,569 | 7/1972 | Larson | 280/32.6 |
| 3,799,566 | 3/1974 | Thompson | 280/20 |
| 3,984,116 | 10/1976 | Bowers | 280/32.6 |
| 4,570,957 | 2/1986 | Rose | 280/32.6 |
| 4,580,799 | 4/1986 | Quinonez | 280/32.6 |
| 4,889,352 | 12/1989 | Chamberlin, Jr. | 280/32.6 |
| 5,174,592 | 12/1992 | Pool | 280/32.6 |
| 5,195,763 | 3/1993 | Scott et al. | 280/32.6 |
| 5,217,315 | 6/1993 | Rosane | 403/102 |
| 5,251,359 | 10/1993 | Finkl | 403/102 |
| 5,364,201 | 11/1994 | LaBarre | 403/102 |
| 5,451,068 | 9/1995 | Shockley | 280/32.6 |
| 5,472,219 | 12/1995 | Eckstrum | 280/32.6 |
| 5,494,305 | 2/1996 | Chen | 280/32.6 |

FOREIGN PATENT DOCUMENTS

| | | | |
|---|---|---|---|
| 18798 | of 1892 | United Kingdom | 403/102 |

OTHER PUBLICATIONS

Damark International, Inc. Catalog, p. 21, Sep. 1995.

*Primary Examiner*—Brian L. Johnson
*Assistant Examiner*—Min Yu
*Attorney, Agent, or Firm*—Dominik & Stein

[57] ABSTRACT

A foldable creeper for supporting a person, the creeper articulated along a line which extends transversely along the approximate longitudinal centerline for movement between an open position and a folded storage position, and comprising articulating joints, a framework comprising longitudinal and transverse frame members, the transverse frame members rigidly connecting left and right longitudinal frame members, said transverse frame members including a central lower segment for supporting a support panel, the central lower segment positioned from one-half to four inches below said longitudinal frame members when said creeper is in the open position, support panels having top sides and bottom sides and connected to said transverse frame members, and casters connected to the frame members for supporting said frame members above the ground when said creeper is in the open position. The creeper is light weight, reduced in thickness, easy to manipulate, and in a preferred embodiment can be folded so that the cushioned sides can either be positioned inwards or outwards when the creeper is folded.

21 Claims, 5 Drawing Sheets

FOLDABLE CREEPER

BACKGROUND OF THE INVENTION

1. Field of the Invention

The present invention is directed to a mechanic's creeper as conventionally used in maintenance of vehicles, and more particularly, to a creeper which can be folded for storage in small storage areas such as a mechanic's tool chest or a vehicle storage area.

2. Description of the Related Art

Creeper devices basically consist of a low-slung rectangular body-supporting platform with casters. Such devices have long been popular among automobile mechanics to allow them easy access to the underside of an automobile. Since creepers are conventionally used in garages where strength and wear resistance are required, creepers have conventionally been sturdy, heavy, and expensive devices. A major draw-back to such creepers is that they can not be secured, for example, inside a conventional mechanic's tool box. A creeper which is left unattended for days or weeks may disappear. Such tool boxes are conventionally provided with drawers of 5 inches in depth and 8 inches in depth. There is thus a need for a sturdy mechanic's creeper which can be made to fit inside a conventional mechanic's tool chest.

Due to their large size and expense, creepers have not been widely used outside of garages. There are, however, a number of uses to which creepers could be put if the creepers did not require so much space.

For example, long-distance truckers are required to make pre-trip and daily visual undercarriage inspections of the brakes and electrical systems of their vehicles. However, it is difficult to slide underneath a truck, particularly a truck which is provided with an aerodynamic skirt. Further, the tarmac of truck parking areas is frequently oily and dirty. A creeper would be a great asset to a trucker, but creepers are difficult to carry along in a truck.

There are other potential uses for creepers by non-commercial persons such as homeowners. For example, it would be desirable to provide more comfortable access to confined low spaces when doing plumbing, home repair, and a multitude of other homeowner tasks which require awkward positioning of the body. Further, backyard mechanics and owners of recreational vehicles require access to the undercarriage of automobiles or recreational vehicles when changing oil or transmission fluid, or inspecting brakes or mechanical components. However, homeowners and recreational vehicle operators have limited space to store tools. Thus, homeowners rarely have mechanic's creepers, and such operations are conventionally carried out by the home mechanic simply crawling under a vehicle while lying on his back. This can lead to oil, grease and dirt on the clothes, which dirt and grease can be transmitted to the home or recreational vehicle if the operator does not have time to change clothes.

Another concern of the homeowner is the ease with which the tool can be used. Tools which are not intuitively easy to use are frequently not purchased or, if purchased, are not used. Other concerns include the cost and aesthetic appearance of the tool.

With the above in mind, various attempts have been made over time to provide a foldable creeper which meets the need of the homeowner, the backyard mechanic, and the recreational vehicle operator.

One approach to addressing the problem of limited space which homeowners and recreational vehicle owners have to store tools is taught in U.S. Pat. 4,889,352 (Chamberlain). Chamberlain teaches a hard foldable creeper comprising two plastic panels hinged to each other. Although the Chamberlain creeper is foldable, the plastic panels are not sufficiently sturdy to bear up to continuous daily use such as by commercial mechanics. Further, the plastic panels are basically hollow, and will not provide sufficient strength for anchoring castors or wheels. Furthermore, due to the design of the hinging mechanism, the creeper can not be folded with the casters left in their bosses. For folding, it is necessary to remove the casters from their respective bosses, and these casters must be stored. This is an inconvenience to the user, increases the wear of the caster sockets, and furthermore allows for the possibility that the casters can become misplaced. One lost caster renders the creeper useless. Finally, as the creeper is not padded, it can not be comfortably used for long periods of time.

Another foldable creeper is taught in U.S. Pat. No. 4,580,799 (Quinonez). Quinonez teaches a foldable creeper with a collapsible seat. However, although the length of the creeper is reduced, the creeper is very thick and bulky when folded and, therefore, is difficult to store within the limited storage space available to a homeowner either in the home or in a vehicle. Furthermore, the casters always face outwards when the creeper is folded.

Therefore, if the creeper casters come into contact with grease or dirt, which is likely due to the environment of use, there exists the potential of transmitting dirt and/or grease from the ground to the casters and from the casters to the area in which the creeper will be stored. This is severely limiting to a homeowner who often stores items of this sort in their clean home or vehicle. This creeper is also not padded.

Yet another foldable creeper is taught in U.S. Pat. No. 3,984,116 (Bowers). The creeper comprises a tri-sectional panel and a telescopic supporting rail section attached to one of the three panels, such that when the panels are unfolded the rail can be extended to provide a backbone for supporting the panels. This creeper is bulky in its folded state which makes it difficult to store in small spaces. The tri-section construction also raises the manufacturing costs of the creeper which will, in turn, raise the price with which the creeper is sold. Furthermore, the casters are constrained to facing outwards in the creeper's folded state and this raises the possibility of transmitting dirt or grease. Finally, the creeper is flat and hard and not comfortable.

Given the public's need to utilize creepers for a variety of tasks requiring awkward positioning of the body, it is an object of the present invention to provide a creeper that is compact, affordable, easy to use, and attenuates the amount of dirt that is transferred from the used creeper to a storage area.

SUMMARY OF THE INVENTION

In view of the foregoing disadvantages inherent in known types of foldable creepers, it is an object of the present invention to provide a creeper which can be compactly folded so that it can be placed in the limited storage area available to homeowners.

It is a further object of the present invention to provide a creeper which can be inexpensively manufactured yet be comfortable, durable, and attractive.

Yet a further object of the present invention is to provide a creeper which can be folded so as to hide the wheels, without requiring removal of the wheels, thus minimizing the amount of dirt and/or grease that can be transferred from the creeper to its storage area or to the user's body.

It is yet a further object of the invention to provide a foldable creeper which can be folded in two different ways, i.e., in the wheels-in orientation and in the wheels-out orientation.

It is yet another object of the invention to provide a creeper which provides padded support and thus can be used for extended periods of time.

Finally, it is an object of the invention to provide a creeper which provides superior comfort, ease of folding, and yet can be folded to a thickness of 10 inches or less, preferably 6.5 inches or less, most preferably 4.5 inches or less.

These and other objects are accomplished by providing a foldable creeper with a unique framework, hinging means, and caster arrangement such that casters of the creeper can be directed outwards when the creeper is in its folded state. In a first folded state longitudinal frame members, to which the casters are preferably attached, are flush against each other so that the casters are perpendicular and directed outwards in opposing directions. In such an arrangement, the minimum thickness of the folded creeper will correspond to twice the thickness of the frame members to which the casters are attached, plus twice the projection length of the casters from the frame members. Generally this will allow for a total minimal thickness of approximately 6.5 inches, more preferably about 6 inches.

A yet more compact arrangement is made when the creeper is folded with wheels facing inward and longitudinal frame members facing outwards. In this manner of folding, the total creeper thickness will correspond to twice the frame thickness plus one times the projection length of the casters from the frame members. That is, since the wheels face inwards all wheels are side-by-side.

The structure of the hinging means, however, also allows placement of casters proximal to the hinging mechanism, i.e., on the frame near the center of the creeper, while still allowing the creeper to be properly folded. Therefore, the creeper can withstand large forces exerted against it's center without collapsing. In addition, not only does the inward positioning of the casters while the creeper is in its folded state attenuate transmission of dirt and/or grease but it allows the present creeper to be more compact than other foldable creepers.

In accordance with a preferred embodiment of the invention, the hinging mechanism, frame design, and caster placement permits the creeper to be folded two different ways, i.e., in a wheels-in orientation and in a wheels-out orientation.

Further, the creeper should, in addition to all the above, be provided with a headrest for increasing the comfort of the mechanic.

Furthermore, the frame is assembled from high-strength frame members, preferably steel beams or tubes, and thus the load bearing members are strong and long-lasting. The frame members may also be constructed of a lightweight material such as aluminum, titanium, magnesium, KEVLAR, carbon-fiber, or high strength plastic.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other foldable creepers for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention reference should be made by the following detailed description taken in with the accompanying drawings in which.

DETAILED DESCRIPTION OF THE INVENTION

After extensive investigation, the inventor has discovered that a creeper can be designed and constructed so as to be attractive and comfortable, durable, inexpensive, foldable to a compact state, and which is less likely to transmit dirt to the user or storage area. In a preferred embodiment of the present invention, the two frame portions are connected via a hinging means such that the creeper can be folded into either a wheels-in or a wheels-out arrangement, either arrangement being a compact enough structure such that the creeper can be easily stored in the home or a vehicle.

Figure 1:
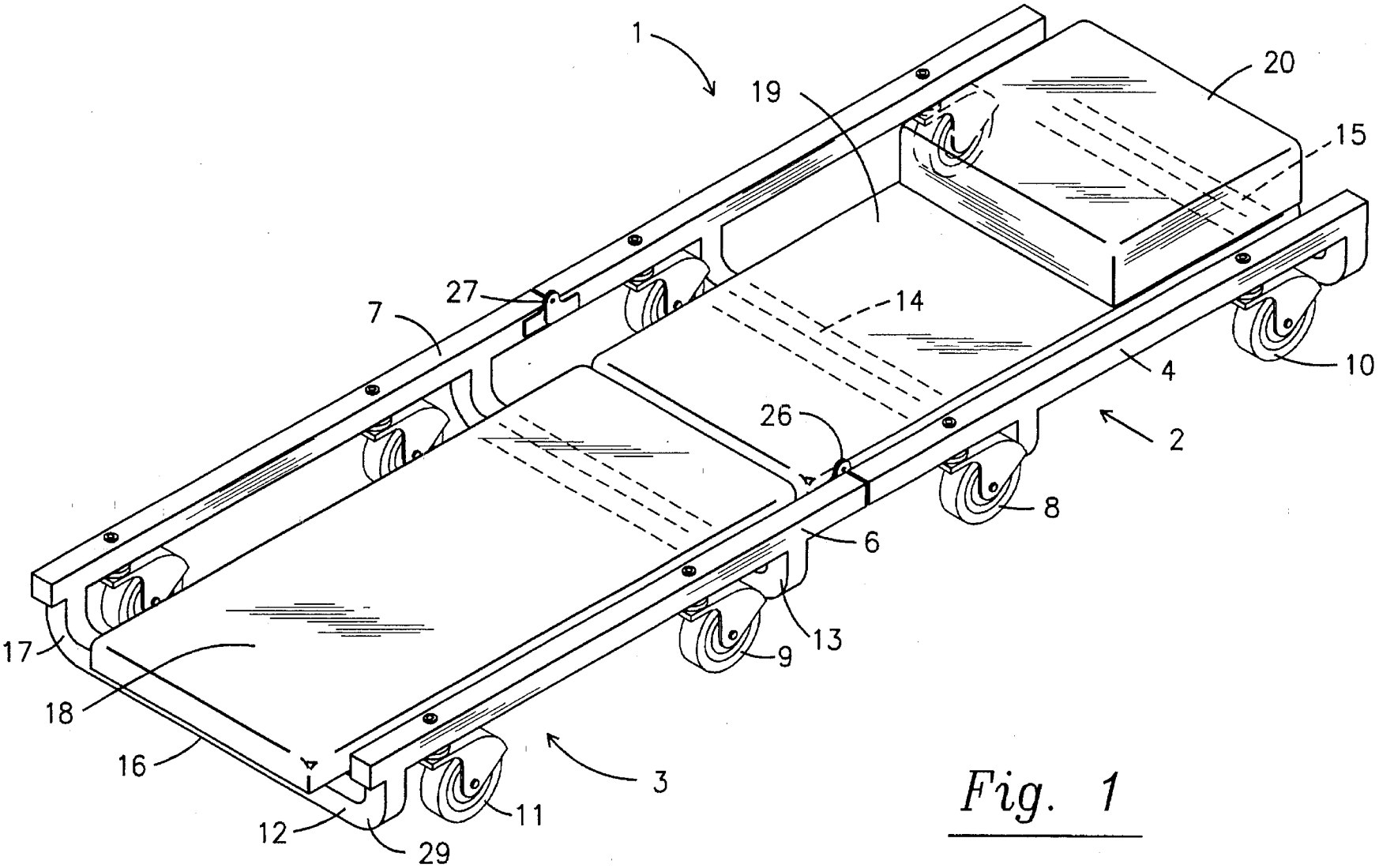
FIG. 1 is an elevated oblique view of a first embodiment of the foldable creeper in its unfolded state.
Figure 2:
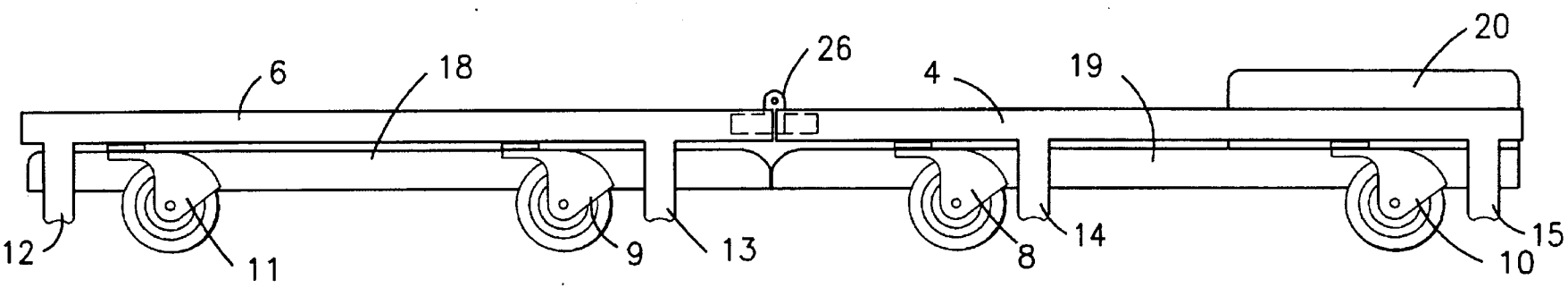
FIG. 2 is a side view of the foldable creeper of FIG. 1 in its unfolded state.
Figure 4:
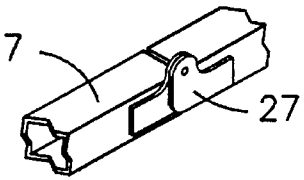
FIG. 4 is an elevated oblique view of a preferred hinging mechanism for said first embodiment.
Figure 3:
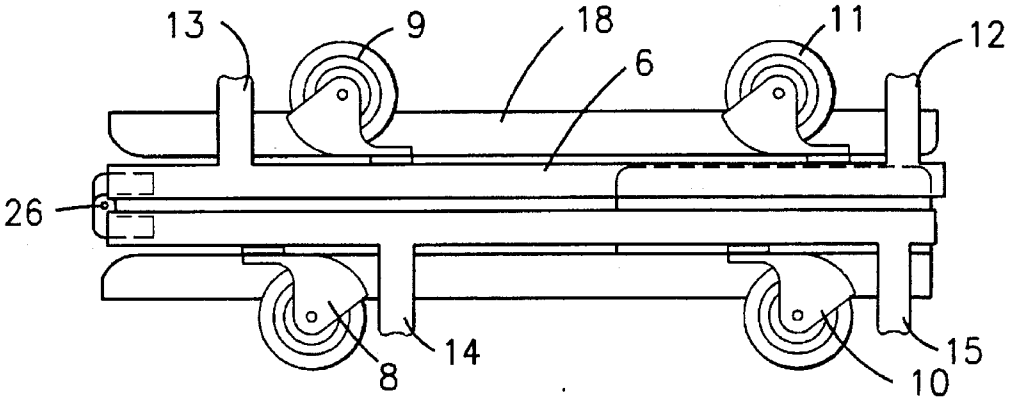
FIG. 3 is a side view of the foldable creeper of FIG. 1 in its folded state.
Figure 5:
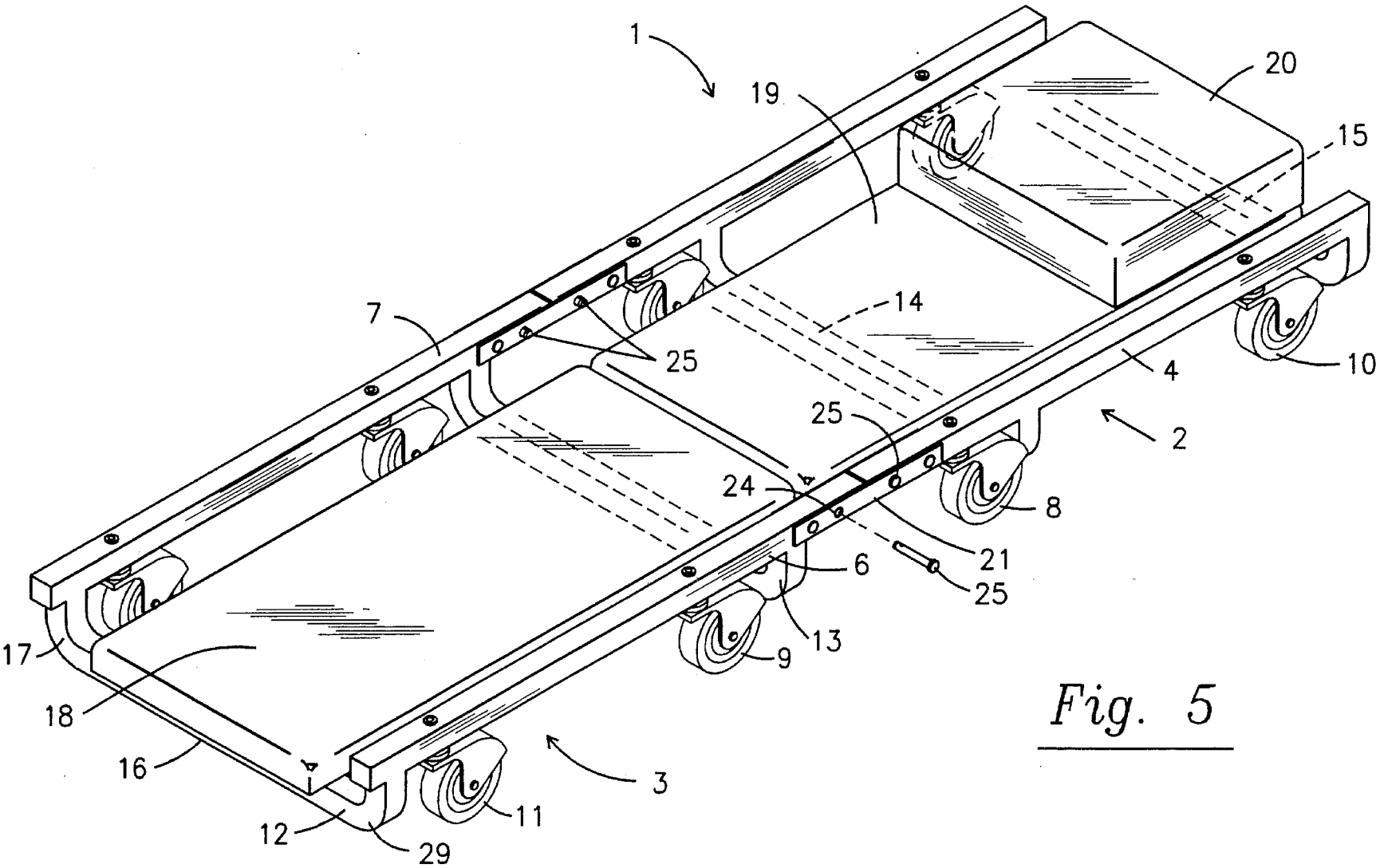
FIG. 5 is an elevated oblique view of a second embodiment of a foldable creeper in its unfolded state.
Figure 6:
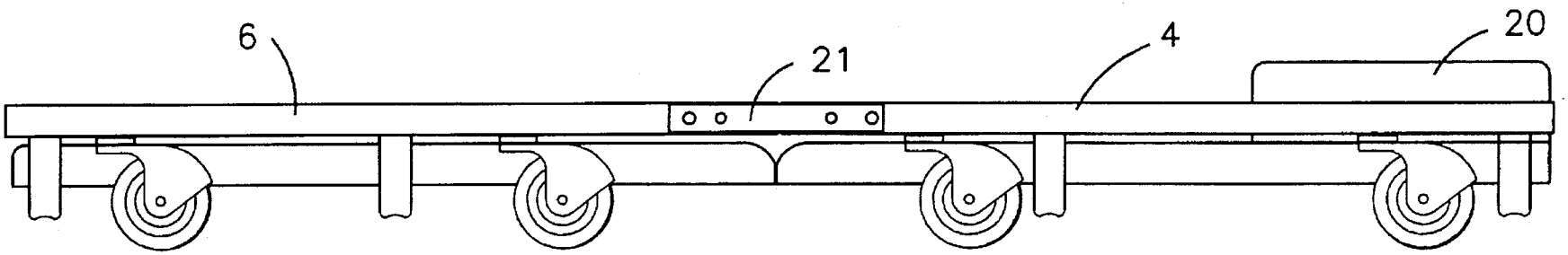
FIG. 6 is a side view of the foldable creeper of FIG. 4 in its unfolded state.

The creeper is constructed around a framework comprised of longitudinal and transverse frame members. The term "transverse" is intended to refer to frame members which connect left and right sides of the frame. There is no requirement that they be perpendicular to the longitudinal frame members—the transverse members may be perpendicular or may diagonal so as to form a cross. Perpendicular transverse members are preferred. The longitudinal members extend lengthwise along the sides of the creeper. In a first embodiment of the invention as shown in FIGS. 1–3 the longitudinal members are separated into two segments at approximately the center of the total creeper length, and connected to each other with a conventional hinge such as a flat tear-drop hinge. Each of the transverse frame members extends from one longitudinal member to the other longitudinal member, forming a rigid framework. The transverse frame members are positioned one or more inches, preferably about two to three inches, below the longitudinal frame members when the creeper is in the unfolded state. Thus, when viewed from the end of the creeper, the transverse frame members form a "U" shape with a straight bottom or cradle portion. Support panels are connected to the strait bottom part of the transverse frame members, and padding is provided on the support panels. When the creeper with the conventional hinge is folded, the longitudinal frame members face each other. The positioning of the transverse members several inches below the longitudinal members permits the incorporation of the support panel and padding and, optionally, a headrest, within a space defined by the superposed "U" shaped members, i.e., a top "U" shape being upside-down and provided on a right-side-up lower "U" shaped transverse frame member.

The cushion attached to the support panel attached to the transverse members is constructed so as to give a comfortable surface on which the user of the creeper may lie. A headrest is attached to the cushion to further increase the comfort with which the creeper can be used.

The longitudinal frame members are provided with downward-facing casters such that the casters contact the ground and support the creeper above the ground when in use. The casters are attached to the longitudinal frame members in conventional manner so as to both rotate and swivel. Preferably each of the four longitudinal frame members is provided with at least two casters, one near the hinge and one away from the hinge, such that the creeper is provided with a total of at least eight casters. This is the minimum number of casters for providing the strongest support for the creeper, such that the creeper can withstand large forces placed on it, for example, forces generated by the weight of a body plus the force of the mechanic working on a vehicle, without collapse. A total of at least four casters per folding segment (half) of the creeper will ensure optimal stability.

The frame design allows the creeper to be easily manipulated, compactly folded, conveniently stored, and inexpensively manufactured.

Figure 8:
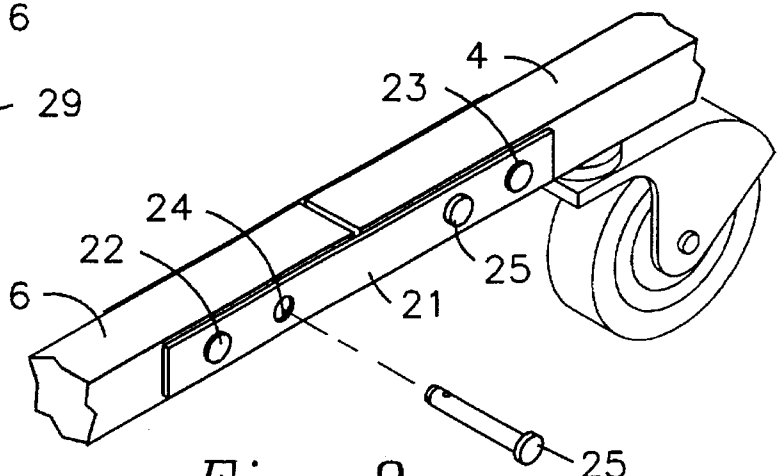
FIG. 8 is a detailed view showing the hinge mechanism and a locking mechanism.
Figure 9:
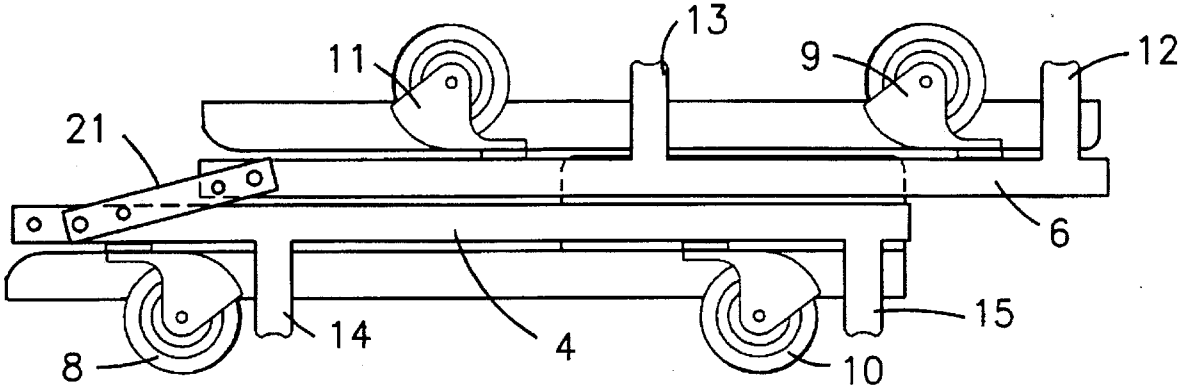
FIG. 9 is a side view of the foldable creeper of FIG. 4 folded in a wheels-out state.
Figure 10:
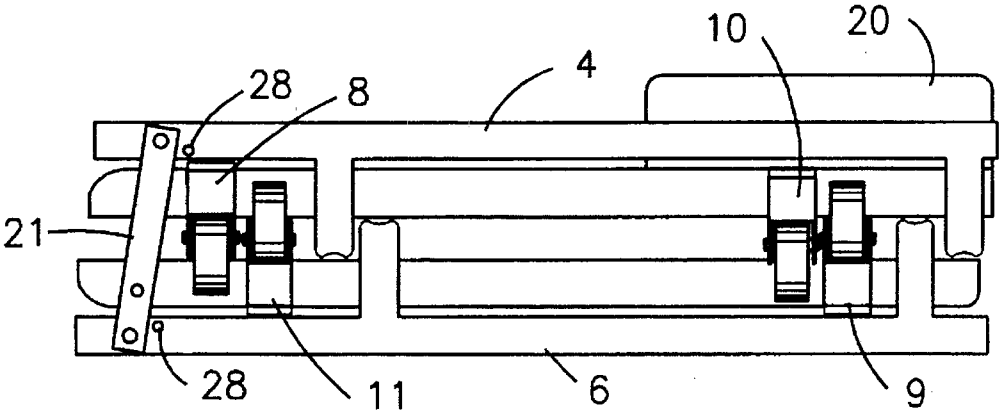
FIG. 10 is a side view of the foldable creeper of FIG. 4 in a wheels-in state.

In a preferred embodiment, as depicted in FIGS. 4–9, the hinging means is constructed such that when the creeper can be folded with the wheel side out and cushion side in, as shown in FIG. 8, or with the cushion side in and wheel side out, as shown in FIG. 9.

Figure 7:
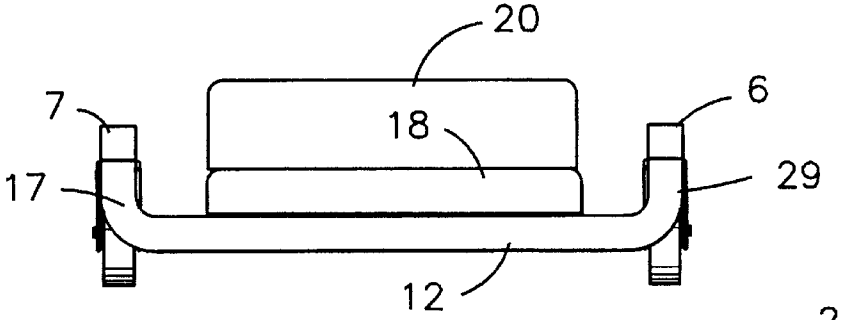
FIG. 7 is an end view of the foldable creeper of FIG. 4 in its unfolded state.

A means for connecting the longitudinal frame members to permit pivoting in either direction is shown in FIG. 7. The longitudinal frame members are connected to each other by means of a flat bar which is attached to the longitudinal frame members by means of hinge pins. Optionally, to make the creeper rigid and incapable of collapse, the hinge means is provided with a locking means such as locking pin.

An important consideration in the second embodiment of the invention is to provide the casters on each longitudinal frame member offset relative to the corresponding casters on the opposing frame member so that the creeper can be properly folded without the casters coming into contact with each other and without coming into contact with the transverse frame members, as clearly shown in FIG. 9.

The operation of the foldable creeper will now be explained in greater detail. After removing the creeper from its storage area, the creeper is transformed from its folded state into its unfolded state. The two unhinged ends of the frame portion are pulled apart until the frame portions are coplanar, and the creeper is placed on the ground in the unfolded state, with only the casters touching the ground. The user of the creeper will then lie on the cushions which rest on the U-shaped transverse rods of the frame piece, usually with his/her head facing upwards but not necessarily so. The creeper can then be slid within close proximity of the area to be worked on by the user while the user is lying on the cushions. Sliding of the creeper can be accomplished by pushing or pulling the creeper with one's hands or legs while lying on its cushions. The area to be worked on will usually be just above the creeper and fairly low to the ground. However, it is to be emphasized that the creeper can be utilized for any task for which the user wishes. Once the task is complete and the user wishes to store the creeper or future use, the user grasps the frame portions at their unhinged ends and brings the two ends within close proximity of each other, whereby one frame portion describes an arc of about 180 degrees. The creeper, in its folded state, is then stored in a closet, tool box, recreational vehicle, trunk of a car, etc.

A first preferred foldable creeper according to the invention will now be discussed in greater detail by reference to FIGS. 1–3.

There is shown in FIG. 1, a creeper 1 comprising two hinged frame portions 2, 3. The first frame portion 2 comprises two longitudinal frame members 4, 5. The second frame portion 3 comprises two longitudinal frame members 6, 7. Each longitudinal frame portion is preferably from 18 to 28 inches, most preferably about 20 inches, in length. Each longitudinal frame member 4, 5, 6, 7 is provided with one inner caster 8, 9 and one outer caster 10, 11, i.e., one caster nearer the hinge and one caster further from the hinge.

Connecting the longitudinal frame members 4, 5, 6, 7 to each other are transverse frame members 12, 13, 14, 15. The transverse frame members are generally "U" shaped when viewed from the ends of the creeper. More specifically, the transverse frame members preferably comprise a main horizontal segment 16 and vertical segments 17, 29 connecting the horizontal segment 16 to longitudinal segments 6, 7.

For the comfort of the mechanic, cushions 18, 19 are provided on each of the frame portions 2, 3. The cushions are generally provided on a rigid support (not shown) such as a section of plywood, plastic, or metal, in order to provide planar support for the mechanic. The cushion may be made of any material generally employed in the art for providing comfort for the mechanic. For example, the cushion may be a foamed rubber (e.g., foamed neoprene, polyurethane, or polyethylene, preferably cross-linked polyethylene), or foamed plastic (e.g., foamed urea-formaldehyde, foamed polyvinyl-formaldehyde plastic, polyester resin reacted with aromatic diisocyanates to form a prepolymer which is then reacted with water to form a plastic urethane polymer which is foamed by coevolved carbon dioxide, phenolformaldehyde resin foams, and polystyrene), natural sponge, or any other such natural or synthetic material known to those in the art to have good stability, biocompatibility, resilience, and impact absorption abilities. The density of the foam layer may vary widely depending upon engineering preferences, but is preferably about 4–6 lbs. per cubic foot, most preferably about 5 lbs. per cubic foot. The layer thickness is not particularly limited, but the cushion has a preferred thickness of about ¼–2 inches. A cushion thicker than 2 inch does not provide significant additional support or comfort, yet increases manufacturing cost and may increase the overall creeper thickness when folded. A cushion less than ½ inch in thickness is reduced in the amount of support and comfort afforded, and less than ¼ will usually not give sufficient support for the desired level of comfort. The foam material is preferably covered by a wear resistant material such as cloth backed polyvinyl chloride.

A headrest 20 may be provided for additional comfort. The headrest is preferably made of the same material as the cushion part 18, 19, but is simply thicker, and is provided at one end of the creeper where the head is expected to rest.

FIG. 2 shows the creeper in the open, unfolded position, with longitudinal frame members 4, 6 aligned. FIG. 3 shows the same creeper as in FIG. 2, but in the closed, folded position, with longitudinal frame members 4, 6 facing each other.

As shown in these figures, the frame members are roughly square in cross-sectional shape, but they may be any desired shape, including circular, oval, or "U" or "L" shaped, and they may be hollow or solid, so long as sufficient strength is imparted.

The lengths and diameters of both the longitudinal and transverse frame members may vary widely depending upon the ultimate design selected by the manufacturer, and may be influenced by consideration such as the size of the person to be accommodated on the creeper, the strength desired for the frame piece, cost, and the ultimate thickness of the creeper in its folded state. The longitudinal and transverse frame members may be welded to each other, bolted to each other, or joined by any conventional means.

It should be apparent from FIGS. 1–3 that the cushion 18, 19 and, optionally, headrest 20 are recessed below the longitudinal frame members 4, 5, 6, 7 so that when the creeper is in the open state on the ground cushion 18, 19 is supported by the transverse frame members 12, 13, 14, 15 slightly above the ground, yet so that the top of the cushion 18, 19 is below the top of the longitudinal frame members 4, 5, 6, 7. This has the advantage that the mechanic is supported closer to the ground, such that the clearance between the mechanic and the underside of the vehicle on which he is working is greater.

If headrest 20 is provided, it may extend above the longitudinal frame member 4 on one side of the creeper, but the top of the cushion 18 on the other side of the creeper should be as far below the longitudinal frame member 6 on one side of the creeper as the headrest 20 extends above the longitudinal frame member 4 on it's side of the creeper. Only so will the creeper fold with longitudinal frame members 4, 6 flush against each other.

The creeper as shown in FIGS. 1–4 may be provided with any conventional hinge, such as a "piano" hinge, but it is preferably provided with a hinge which satisfies two conditions: (1) the longitudinal frame members abut when the creeper is in the open position, and (2) the longitudinal frame members are slightly spaced apart at the hinged end when the creeper is in the closed position, so as to provide room for any caster mounting hardware extending above the upper surface of the longitudinal frame members. That is, without the provision of a small space at the hinge, any hardware for mounting the casters is likely to break the hinges when the creeper is closed.

The main difference between the creeper of the first embodiment as shown in FIGS. 1–3 and the creeper of the second embodiment as shown in FIGS. 4–9 is in the hinge mechanism. The hinge mechanism of the second embodiment permits the creeper to be folded not only in the cushion-to-cushion orientation as shown in FIG. 8, and as was possible with the creeper of the first embodiment, but the creeper of the second embodiment may also be folded in the wheel-to-wheel orientation as shown in FIG. 9, provided of course that the casters and transverse frame members are spaced so as not to interfere with each other in folding.

The hinge means preferably comprises a bar 21 with at least two bore-holes near the respective ends of the bar, through which bore holes bolts or studs 22, 23 secure the bar 21 to the longitudinal frame members 4, 6. The bolts or studs 22, 23 pass through the bore holes in the bar and then through bore holes in the bar longitudinal frame members 4, 6. The bar maintains a specific spacing between these boreholes in the longitudinal frame members 4, 6. When the creeper is open, the hinge ends of longitudinal frame members 4, 6 abut as shown in FIG. 7. When the creeper is folded in the wheel-to-wheel orientation as shown in FIG. 9, the bar 21 maintains a proper spacing of the longitudinal frame members 4, 6 such that the transverse frame members make flush contact with the backs of the cushions. When the creeper is folded in the cushion-to-cushion orientation as shown in FIG. 8, the bar 21 may permit a larger than necessary space between the the longitudinal frame members 4, 6, but the bar 21 may be skewed as shown in FIG. 8 so that the longitudinal frame members 4, 6 are flush against each other.

Furthermore, a locking means such as locking pin 25 can be utilized to secure the creeper 1 in its open state. This may be preferred where the creeper is subject to heavy-duty use, such as in a commercial garage.

Securing means such as straps may also be provided to secure the creeper 1 is in its folded state, for example, for storage in a recreational vehicle. The straps can be releasably attached to the sides of the creeper 1 through the use of snaps or some other commonly used means.

As to the manner of usage and operation of the two embodiments of the present invention described above, the same should be apparent from the above description.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Now that the invention has been described,

What is claimed is:

1. A foldable creeper for supporting a person, said creeper having a top side, a bottom side, left and right sides, and head and foot ends, said creeper articulated along a line which extends transversely along the approximate longitudinal centerline for movement between an open position and a folded storage position, and comprising:

(a) articulating joints;

(b) a framework comprising longitudinal and transverse frame members, said longitudinal frame members extending lengthwise along said left and right sides of the creeper, said longitudinal frame members articulated via said articulating joints at a line which extends transversely along the approximate longitudinal centerline to define in said longitudinal frame members head end longitudinal frame member segments and foot end longitudinal frame member segments, said transverse frame members rigidly connecting left and right longitudinal frame members, said transverse frame members including a central lower segment for supporting a support panel, said central lower segment of said transverse member oriented from one-half to four inches below said longitudinal frame members when said creeper is in the open position;

(c) support panels having top sides and bottom sides and connected to said transverse frame members; and (d) casters connected to said frame members for supporting said frame members above the ground when said creeper is in the open position, wherein said articulating joints are constructed to permit said creeper to be folded between a first closed position, a second closed position, and an open position intermediate set first closed position and second closed position, wherein said first closed position is one wherein said top sides of said support panels face each other, and said second position is one wherein said bottom sides of said support panels face each other when said creeper is in the folded position.

2. A foldable creeper as in claim 1, further comprising locking means for locking said creeper in an open position.

3. A foldable creeper as in claim 1, wherein said left and right head-end longitudinal frame member segments are connected to each other via at least two transverse frame member segments, and wherein said left and right foot-end longitudinal frame member segments are connected to each other via at least two transverse frame member segments.

4. A foldable creeper as in claim 1, wherein said longitudinal and transverse frame members are hollow.

5. A foldable creeper as in claim 1, wherein said longitudinal and transverse frame members are metal.

6. A foldable creeper as in claim 1, further including padding provided on the top side of said support panels.

7. A foldable creeper as in claim 6, further including a headrest at said head end of said creeper.

8. A foldable creeper as in claim 1, wherein said central lower segment of each of said transverse frame members is positioned from one to four inches below said longitudinal frame members when said creeper is in the open position.

9. A foldable creeper as in claim 1, wherein said central lower segment of each of said transverse frame members is positioned from two to three inches below said longitudinal frame members when said creeper is in the open position.

10. A foldable creeper as in claim 1, wherein said left head-end longitudinal frame member segment is flush against said left foot-end longitudinal frame member segment and said right head-end longitudinal frame member segment is flush against said right foot-end longitudinal frame member segment when said creeper is in the folded position.

11. A foldable creeper as in claim 1, wherein each of said head-end longitudinal frame member segments and foot-end longitudinal frame member segments is provided with at least two casters.

12. A foldable creeper for supporting a person, said creeper having a top side, left and right sides, and head and foot ends, said creeper articulated along a line which extends transversely along the approximate longitudinal centerline for movement between an open position and a folded storage position, and comprising:

(a) articulating joints;

(b) a framework comprising longitudinal and transverse frame members, said longitudinal frame members extending lengthwise along said left and right sides Of the creeper, said longitudinal frame members articulated via said articulating joints at a line which extends transversely along the approximate longitudinal centerline to define in said longitudinal frame members head end longitudinal frame member segments and foot end longitudinal frame member segments, said transverse frame members rigidly connecting left and right longitudinal frame members, said transverse frame members including a central lower segment for supporting a support panel, said central lower segment of said transverse member oriented from one-half to four inches below said longitudinal frame members when said creeper is in the open position;

(c) support panels having top sides and bottom sides and connected to said transverse frame members; and (d) casters connected to said frame members for supporting said frame members above the ground when said creeper is in the open position, wherein said articulating joints are constructed to permit said creeper to be folded such that said bottom sides of said support panels face each other when said creeper is in the folded position, with wheels spaced from each other when the creeper is in a folded position, and with transverse frame members spaced from each other when the creeper is in a folded position said wheels and said transverse frame members are spaced side by side when the creeeper is folded.

13. A foldable creeper as in claim 12, further comprising locking means for locking said creeper in an open position.

14. A foldable creeper as in claim 12, wherein said left and right head-end longitudinal frame member segments are connected to each other via at least two transverse frame member segments, and wherein said left and right foot-end longitudinal frame member segments are connected to each other via at least two transverse frame member segments.

15. A foldable creeper as in claim 12, wherein said longitudinal and transverse frame members are hollow.

16. A foldable creeper as in claim 12, wherein said longitudinal and transverse frame members are metal.

17. A foldable creeper as in claim 12, further including padding provided on the top side of said support panels.

18. A foldable creeper as in claim 17, further including a headrest at said head end of said creeper.

19. A foldable creeper as in claim 12, wherein said central lower segment of each of said transverse frame members is positioned from one to four inches below said longitudinal frame members when said creeper is in the open position.

20. A foldable creeper as in claim 12, wherein said central lower segment of each of said transverse frame members is positioned from two to three inches below said longitudinal frame members when said creeper is in the open position.

21. A foldable creeper as in claim 12, wherein each of said head-end longitudinal frame member segments and foot-end longitudinal frame member segments is provided with at least two casters.

* * * * *